US012656066B2

(12) United States Patent
Chen et al.

(10) Patent No.: US 12,656,066 B2
(45) Date of Patent: Jun. 16, 2026

(54) STEPPED MESH-STACKED POWDER-FILLING STRUCTURE AND VAPOR CHAMBER USING SAME

(71) Applicant: Delta Electronics, Inc., Taoyuan City (TW)

(72) Inventors: Wen-Shiang Chen, Taoyuan City (TW); Yuan-Chia Chung, Taoyuan City (TW)

(73) Assignee: Delta Electronics, Inc., Taoyuan City (TW)

( * ) Notice: Subject to any disclaimer, the term of this patent is extended or adjusted under 35 U.S.C. 154(b) by 95 days.

(21) Appl. No.: 18/772,555

(22) Filed: Jul. 15, 2024

(65) Prior Publication Data

US 2025/0369702 A1 Dec. 4, 2025

(30) Foreign Application Priority Data

May 31, 2024 (CN) ..... 202421223152.3

(51) Int. Cl.
*F28D 15/04* (2006.01)

(52) U.S. Cl.
CPC ..... *F28D 15/046* (2013.01)

(58) Field of Classification Search
CPC ..... F28D 15/02; F28D 15/04; F28D 15/046
USPC ..... 165/80.4, 104.26
See application file for complete search history.

(56) References Cited

U.S. PATENT DOCUMENTS 9,835,383 B1 * 12/2017 Roper ..... F28D 15/046
10,451,355 B2 * 10/2019 Lan ..... F28D 15/0275
11,359,869 B2 * 6/2022 Wakaoka ..... F28D 15/0233
11,454,454 B2 * 9/2022 Liu ..... F28D 15/04
11,466,937 B2 * 10/2022 Chiang ..... C23C 18/31
12,078,423 B2 * 9/2024 Inagaki ..... F28D 15/0266
12,158,309 B2 * 12/2024 Liu ..... F28D 15/0233
12,385,697 B2 * 8/2025 Lewis ..... F28D 15/0233
12,480,716 B2 * 11/2025 Lewis ..... F28D 15/0283
12,498,181 B2 * 12/2025 Lewis ..... F28D 15/046
12,560,388 B2 * 2/2026 Wang ..... F28D 15/046
2011/0088877 A1 * 4/2011 Oniki ..... H10W 40/73 29/890.032
2013/0025829 A1 * 1/2013 Huang ..... F28D 15/0233 165/104.26

(Continued)

FOREIGN PATENT DOCUMENTS

CN 219305295 U 7/2023

*Primary Examiner* — Claire E Rojohn, III

(74) *Attorney, Agent, or Firm* — KIRTON McCONKIE; Evan R. Witt

(57) ABSTRACT

A stepped mesh-stacked powder-filling structure is disclosed and includes a cover plate, a first mesh plate, a second mesh plate and a wick structure. The first mesh plate is stacked on an inner surface of the cover plate along a first direction, and includes a first through opening. The second mesh plate is stacked on the first mesh plate along the first direction and includes a second through opening in communication with the inner surface through the first through opening. The second through opening is greater than the first through opening in view of the first direction, and a top surface of the first mesh plate not covered by the second mesh plate forms a first overlapping surface. The wick structure is disposed in the first and second through openings, and connected to the first mesh plate through the first overlapping surface.

15 Claims, 12 Drawing Sheets

(56) References Cited

U.S. PATENT DOCUMENTS

| | | | | |
|---|---|---|---|---|
| 2013/0175008 | A1* | 7/2013 | Yeh | F28D 15/0233 165/104.26 |
| 2013/0206369 | A1* | 8/2013 | Lin | F28D 15/043 165/104.26 |
| 2014/0060781 | A1* | 3/2014 | Jia | F28D 15/0275 29/890.032 |
| 2014/0182819 | A1* | 7/2014 | Yang | F28D 15/04 165/104.26 |
| 2016/0131437 | A1* | 5/2016 | Wu | F28D 15/04 165/104.26 |
| 2016/0320143 | A1* | 11/2016 | Fan | F28D 15/046 |
| 2018/0320984 | A1* | 11/2018 | Lewis | F28D 15/0283 |
| 2019/0090386 | A1* | 3/2019 | Shioga | H05K 7/20336 |
| 2019/0376747 | A1* | 12/2019 | Cheng | F28F 3/046 |
| 2020/0003501 | A1* | 1/2020 | Wakaoka | F28D 15/046 |
| 2020/0045848 | A1* | 2/2020 | Wakaoka | H05K 7/20336 |
| 2020/0049421 | A1* | 2/2020 | Wakaoka | F28D 15/04 |
| 2020/0248969 | A1* | 8/2020 | Sudhakar | F28D 15/046 |
| 2020/0309470 | A1* | 10/2020 | Huang | F28D 15/0283 |
| 2020/0333083 | A1* | 10/2020 | Lin | F28D 15/043 |
| 2020/0355444 | A1* | 11/2020 | Chen | F28D 15/0233 |
| 2021/0136955 | A1* | 5/2021 | Wakaoka | F28D 15/046 |
| 2021/0148646 | A1* | 5/2021 | Sun | F28D 15/046 |
| 2023/0012170 | A1* | 1/2023 | Lin | H05K 7/20336 |
| 2023/0262942 | A1* | 8/2023 | Chen | H05K 7/20509 165/80.3 |
| 2024/0310126 | A1* | 9/2024 | Liu | F28D 15/0266 |
| 2025/0251199 | A1* | 8/2025 | Wang | F28D 15/046 |
| 2025/0290706 | A1* | 9/2025 | Chen | F28D 15/0233 |
| 2025/0369702 | A1* | 12/2025 | Chen | F28D 15/0233 |

* cited by examiner

STEPPED MESH-STACKED POWDER-FILLING STRUCTURE AND VAPOR CHAMBER USING SAME

CROSS-REFERENCE TO RELATED APPLICATION

This application claims priority to China Patent Application No. 202421223152.3, filed on May 31, 2024. The entireties of the above-mentioned patent application are incorporated herein by reference for all purposes.

FIELD OF THE INVENTION

The present disclosure relates to a vaper chamber structure and more particularly to a stepped mesh-stacked powder-filling structure and a vapor chamber using the same.

BACKGROUND OF THE INVENTION

In conventional vapor chamber products, the plate of the vapor chamber contacted with the heat source is mostly combined with stacked mesh plates and wick structures. However, due to the different shrinkage ratios of mesh plates and the sintered copper powder, it is easy to form a disconnection at the vertical interface between the mesh plates and the sintered copper powder. As a result, the working fluid in this area cannot flow back smoothly, and the performance of the vapor chamber is affected seriously.

Furthermore, under the increasingly stringent product performance requirements, the conventional design of the wick structure combining copper powder filling with mesh plates is increasingly no longer meeting the requirements of use. Therefore, how to further improve the working fluid flow-back capability on the conventional connection interface has become the focus of research and development of various companies.

Therefore, there is a need of providing a stepped mesh-stacked powder-filling structure and a vapor chamber using the same to provide a stepped accommodation space by stacking the mesh plates for filling copper powder that is further sintered into a porous wick structure, so that the problem of working fluid back flow disconnection caused by the different sintering shrinkage ratios of the mesh plates and the copper powder is solved sufficiently. Thereby, the heat dissipation capabilities of the product are greatly improved and the drawbacks encountered by the prior arts are obviated.

SUMMARY OF THE INVENTION

An object of the present disclosure is to provide a stepped mesh-stacked powder-filling structure and a vapor chamber using the same. A stepped accommodation space is formed by stacking the mesh plates for filling the metal powder that is further sintered into a porous wick structure, so that the problem of working fluid back flow disconnection caused by the different sintering shrinkage ratios of the mesh plates and the metal powder is solved sufficiently. Thereby, the heat dissipation capabilities of the product are greatly improved.

Another object of the present disclosure is to provide a stepped mesh-stacked powder-filling structure and a vapor chamber using the same. The vapor chamber includes an upper cover structure and a lower cover structure that are paired with each other. The stepped mesh-stacked powder-filling structure is disposed and corresponding to the heat source, and can be formed on the upper cover structure or/and the lower cover structure. When a plurality of mesh plates are stacked on the cover plate through a hot pressing process, the opening areas of the through openings in the plural mesh plates are increased vertically from the inner surface of the cover plate to form a stepped accommodation space. After the metal powder such as the copper powder is filled in the stepped accommodation space, it can be sintered into a porous wick structure with a porosity smaller than the porosity of the mesh plates. Moreover, a good fluid communication between the wick structure and the mesh plates is formed through the first horizontal overlapping surface. In this way, the mesh plates in the vapor chamber can smoothly guide the working fluid to flow back to the wick structure in the horizontal direction.

A further object of the present disclosure is to provide a stepped mesh-stacked powder-filling structure and a vapor chamber using the same. In order to form a stepped accommodation space to fill the metal powder for sintering, a plurality of mesh plates are stacked upwardly from the inner surface of the cover plate to increase the opening areas of the through openings disposed thereof and corresponding to the position of the heat source. Preferably, the shape of the through openings is for example but not limited to rectangular, circular or rhombus. The number of the first overlapping surfaces is adjustable according to the practical requirements. Moreover, the first overlapping surface can be located adjacent to a partial side or all of the periphery of the corresponding through opening. In this way, the plurality of mesh plates can be stacked in various ways to form the stepped accommodation space with sufficient first overlapping surfaces in different regions of the cover plate, so that the metal powder filled into the stepped accommodation for sintering. Consequently, the problem of working fluid back flow disconnection caused by the different sintering shrinkage ratios of the mesh plates and the metal powder is solved sufficiently. Thereby, the heat dissipation capabilities of the product are greatly improved, the back-flow efficiency of the working fluid inside the vapor chamber is greatly improved, and the overall performance of the vapor chamber is improved.

In accordance with an aspect of the present disclosure, a stepped mesh-stacked powder-filling structure is provided. The stepped mesh-stacked powder-filling structure includes a cover plate, a first mesh plate, a second mesh plate and a wick structure. The cover plate includes an outer surface and an inner surface opposite to each other. The first mesh plate is stacked on the inner surface of the cover plate along a first direction, and includes a first through opening, wherein the first through opening is in fluid communication with the inner surface. The second mesh plate is stacked on the first mesh plate along the first direction and includes a second through opening, wherein the second through opening is in fluid communication with the inner surface through the first through opening, the second through opening is greater than the first through opening in view of the first direction, and a top surface of the first mesh plate corresponding to the second through opening forms a first overlapping surface that is not covered by the second mesh plate. The wick structure is disposed in the first through opening and the second through opening, and at least in fluid communication with the first mesh plate through the first overlapping surface.

In an embodiment, the first mesh plate and the wick structure are at least partially overlapped in view of the first direction.

In an embodiment, the outer surface of the cover plate is attached to a heat source, and the first through opening has an area not less than that of the heat source in view of the first direction.

In an embodiment, the first mesh plate and the second mesh plate are stacked on the cover plate through a hot pressing process.

In an embodiment, the first mesh plate has a bottom surface attached to the inner surface of the cover plate, and the second mesh plate has a bottom surface attached to a top surface of the first mesh plate, wherein the first mesh plate and the second mesh plate are configured to guide a working fluid to flow back to the wick structure along a second direction, and the second direction is perpendicular to the first direction.

In an embodiment, the first overlapping surface is connected between a peripheral edge of the second through opening and a peripheral edge of the first through opening, and the first overlapping surface has an extending direction perpendicular to the first direction.

In an embodiment, the first through opening and the second through opening are rectangular in view of the first direction, respectively, and the first overlapping surface is disposed adjacent to one side, two connected sides, and two opposite sides, or three connected sides of the first through opening.

In an embodiment, the first through opening and the second through opening are circular in view of the first direction, respectively, and the first overlapping surface is disposed adjacent to an outer periphery of the first through opening.

In an embodiment, the first through opening and the second through opening are rhombus in view of the first direction, respectively, and the first overlapping surface is disposed around an outer periphery of the first through opening.

In an embodiment, the first through opening and the second through opening collaboratively form a stepped accommodation space, and the wick structure is accommodated in the stepped accommodation space.

In an embodiment, the wick structure is a porous capillary structure formed by filling the stepped accommodation space with metal powder and then sintering the metal power.

In an embodiment, the first mesh plate and the second mesh plate are a copper mesh, respectively, the metal powder is a copper powder, and the wick structure has a porosity smaller than that of the first mesh plate and the second mesh plate.

In an embodiment, the first mesh plate is formed by stacking two layers of mesh plate structure.

In an embodiment, the stepped mesh-stacked powder-filling structure further includes a third mesh plate, wherein the third mesh plate is stacked on the second mesh plate along the first direction, and comprises a third through opening, wherein the third through opening is in fluid communication with the inner surface through the second through opening and the first through opening, and spatially corresponding to the second through opening and the first through opening, wherein the third through opening is greater than the second through opening in view of the first direction, and a top surface of the second mesh plate corresponding to the third through opening forms a second overlapping surface that is not covered by the third mesh plate, wherein the wick structure is disposed in the first through opening, the second through opening and the third through opening, at least in fluid communication with the first mesh plate through the first overlapping surface, and at least in fluid communication with the second mesh plate through the second overlapping surface.

In accordance with another aspect of the present disclosure, a vapor chamber is provided. The vapor chamber includes an upper cover structure and a lower cover structure paired and assembled with each other to form the vaper chamber, wherein the upper cover structure or/and the lower cover structure includes a stepped mesh-stacked powder-filling structure, and the stepped mesh-stacked powder-filling structure includes a cover plate, a first mesh plate, a second mesh plate and a wick structure. The cover plate includes an outer surface and an inner surface opposite to each other. The first mesh plate is stacked on the inner surface of the cover plate along a first direction, and includes a first through opening, wherein the first through opening is in fluid communication with the inner surface. The second mesh plate is stacked on the first mesh plate along the first direction and includes a second through opening, wherein the second through opening is in fluid communication with the inner surface through the first through opening, the second through opening is greater than the first through opening in view of the first direction, and a top surface of the first mesh plate corresponding to the second through opening forms a first overlapping surface that is not covered by the second mesh plate. The wick structure is disposed in the first through opening and the second through opening, and at least in fluid communication with the first mesh plate through the first overlapping surface.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1:
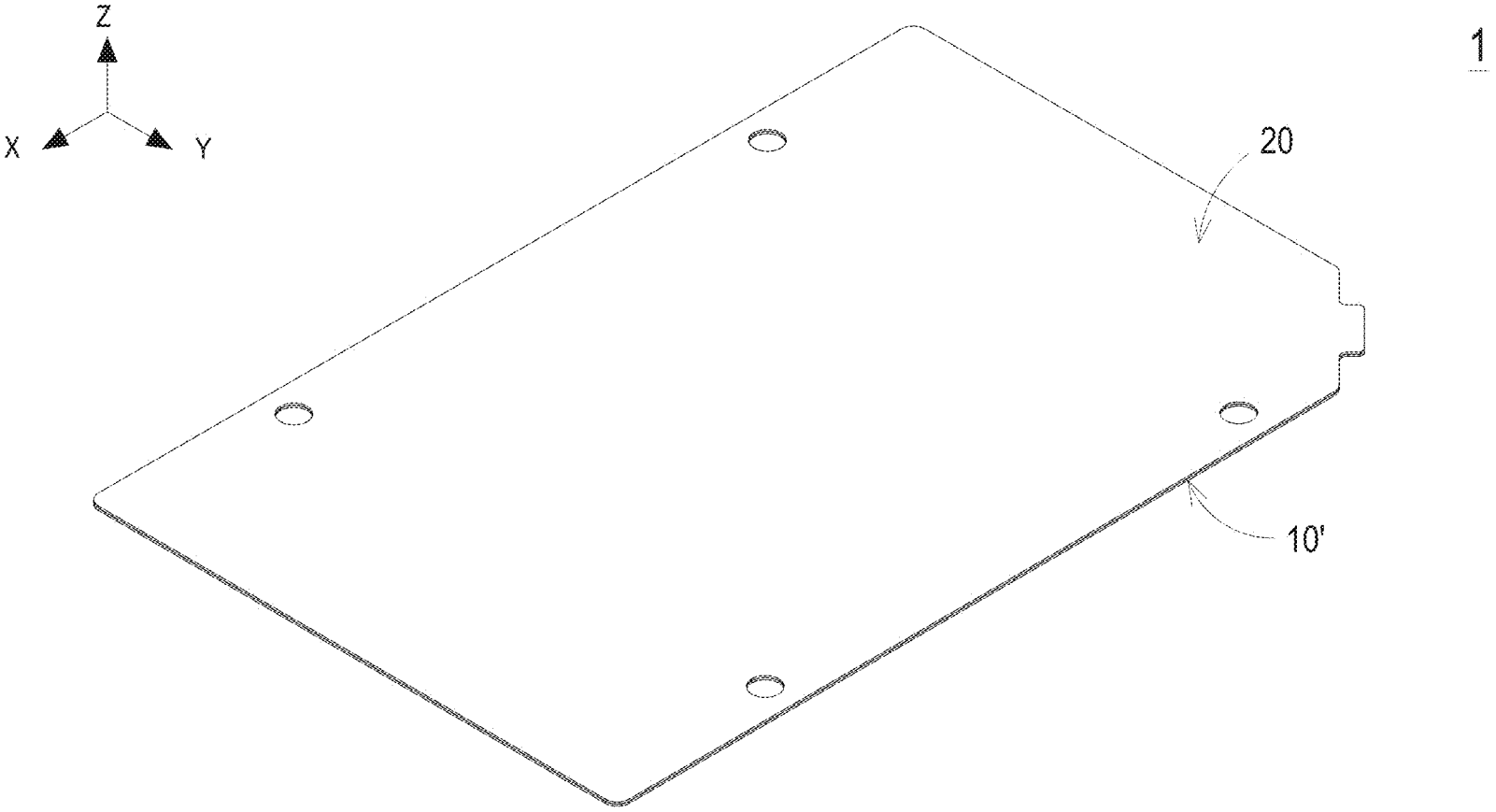
FIG. 1 is a structural perspective view illustrating a vapor chamber according to an embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "inner," "outer," "top surface," "bottom surface" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected," or "coupled," to another element, it can be directly connected or coupled to the other element or intervening elements may be present. Although the wide numerical ranges and parameters of the present disclosure are approximations, numerical values are set forth in the specific examples as precisely as possible. In addition, although the "first," "second, and the like terms in the claims be used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments. Besides, "and/or" and the like may be used herein for including any or all combinations of one or more of the associated listed items.

Figure 2:
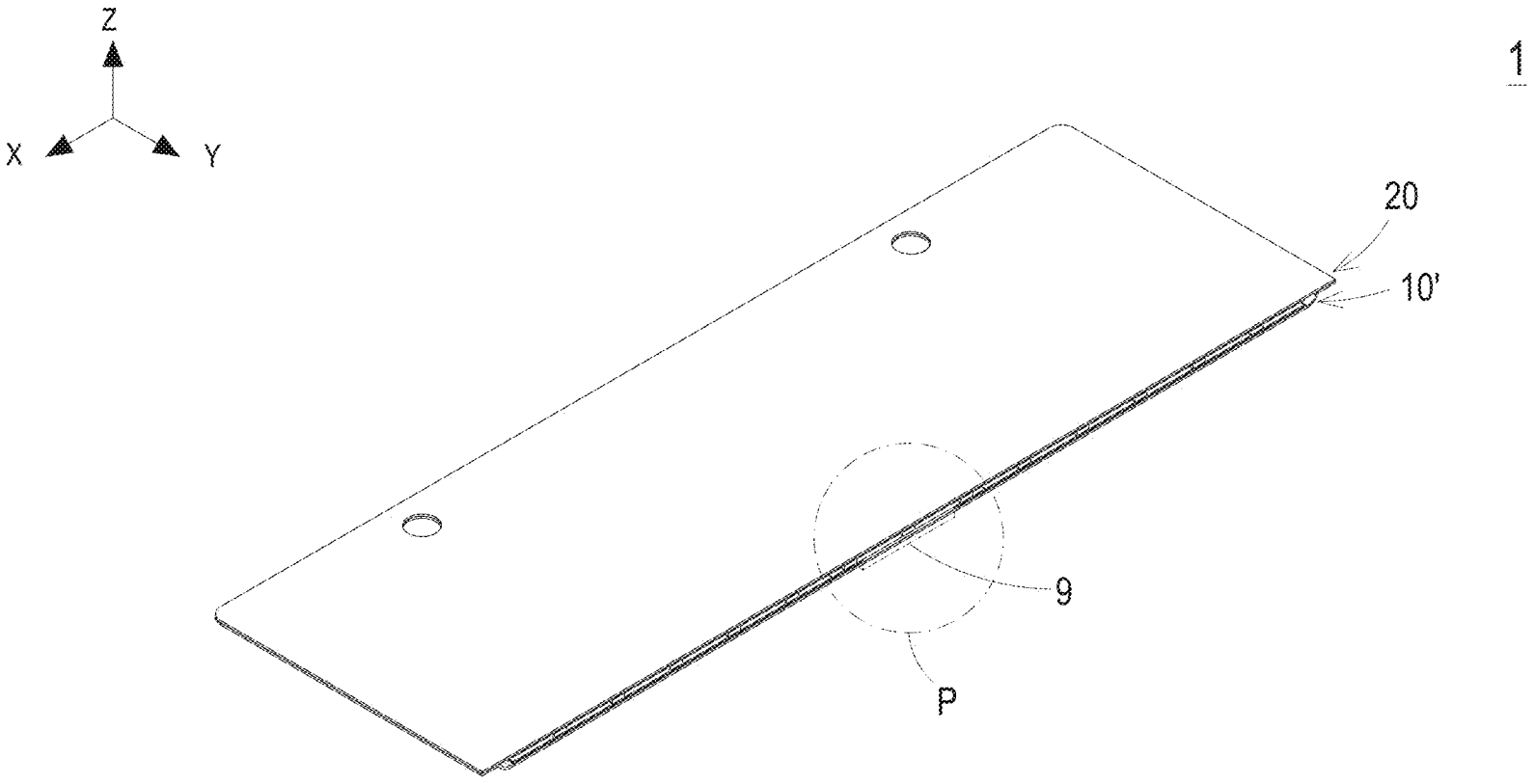
FIG. 2 is a cross-sectional structural view illustrating the vapor chamber according to the embodiment of the present disclosure.
Figure 3:
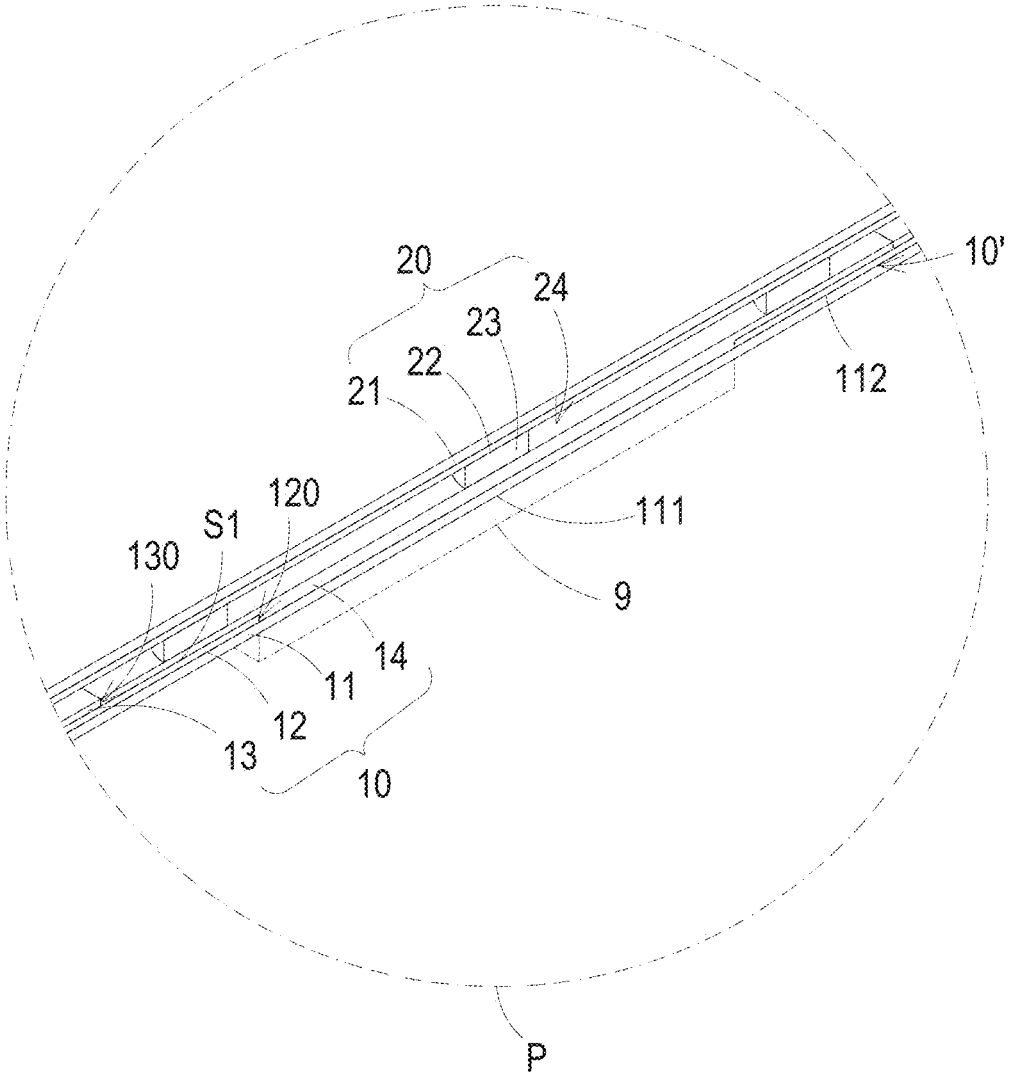
FIG. 3 is an enlarged view illustrating the area P in FIG. 2.
Figure 4:
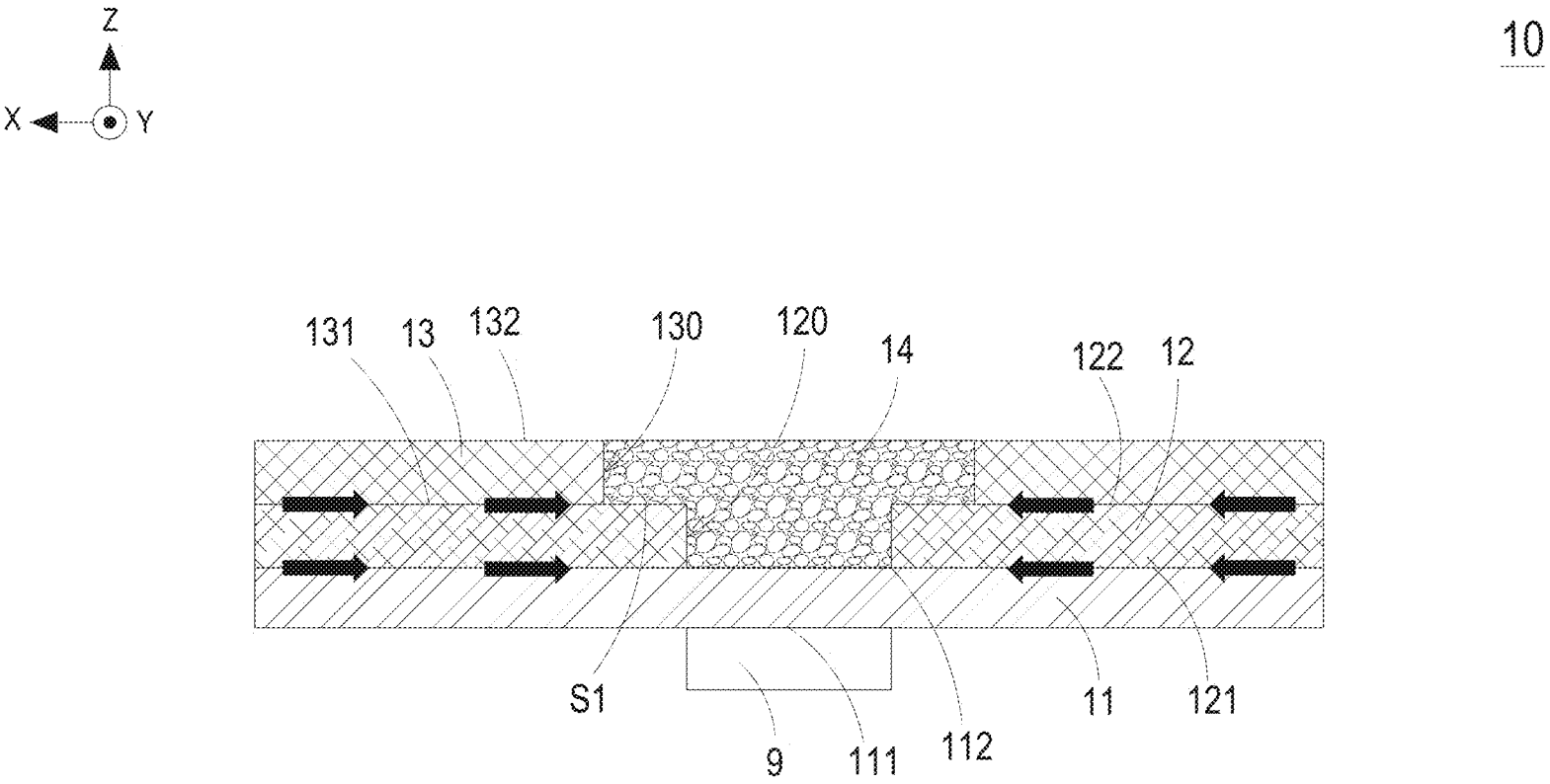
FIG. 4 is a schematic cross-sectional view illustrating a stepped mesh-stacked powder-filling structure according to a first embodiment of the present disclosure.
Figure 5:
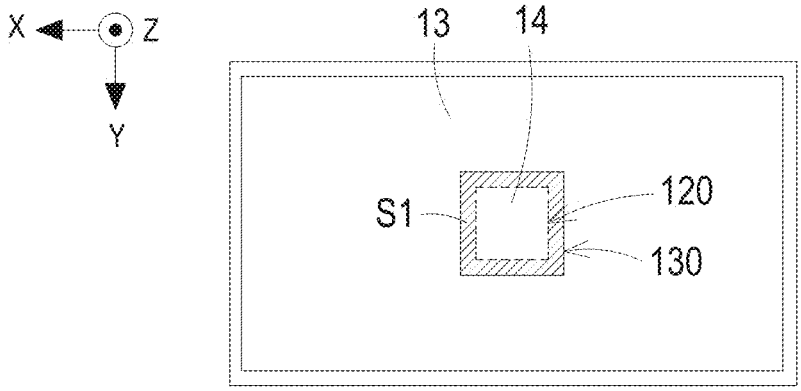
FIG. 5 is a top view illustrating the stepped mesh-stacked powder-filling structure according to the first embodiment of the present disclosure.
Figure 6A:
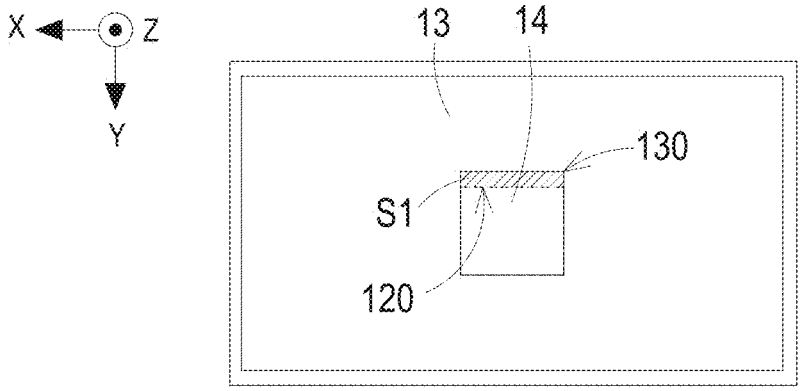
FIG. 6A to FIG. 6D show different examples of the stepped mesh-stacked powder-filling structure in the present disclosure including the first overlapping surface arranged on one single side.
Figure 6B:
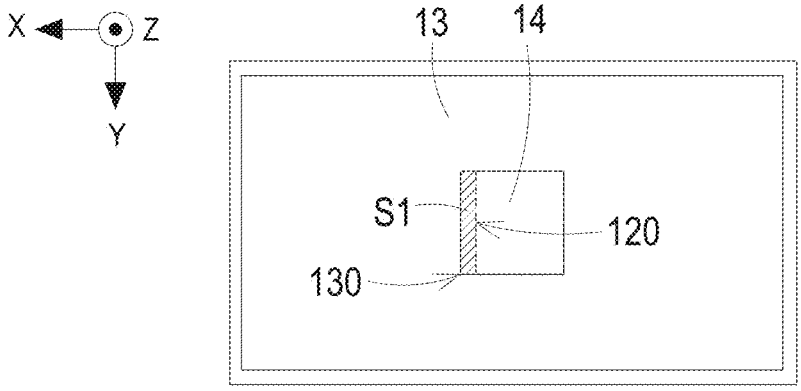
Figure 6C:
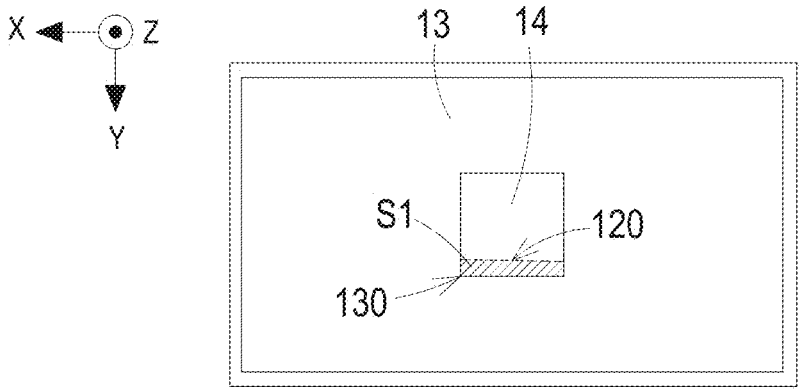
Figure 6D:
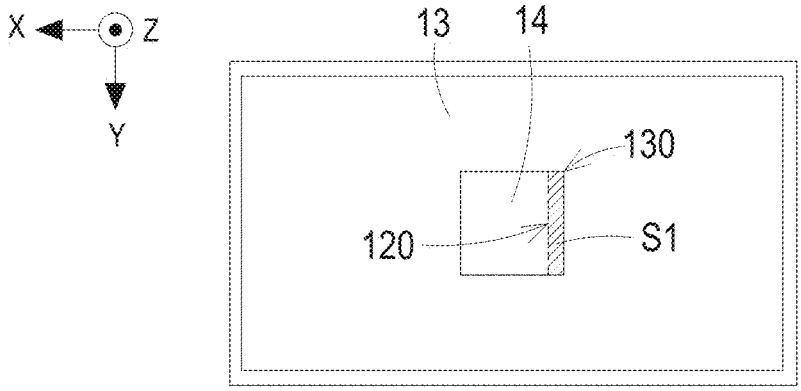

FIG. 1 is a structural perspective view illustrating a vapor chamber according to an embodiment of the present disclosure. FIG. 2 is a cross-sectional structural view illustrating the vapor chamber according to the embodiment of the present disclosure. FIG. 3 is an enlarged view illustrating the area P in FIG. 2. FIG. 4 is a schematic cross-sectional view illustrating a stepped mesh-stacked powder-filling structure according to a first embodiment of the present disclosure. FIG. 5 is a top view illustrating the stepped mesh-stacked powder-filling structure according to the first embodiment of the present disclosure. In the embodiment, a vapor chamber 1 is provided and includes an upper cover structure 20 and a lower cover structure 10'. The upper cover structure 20 and the lower cover structure 10' are paired and assembled with each other to form the vaper chamber 1. In the embodiment, the upper cover structure 20 includes a cover plate 21, a wick structure 22 and support columns 23. The wick structure 22 is disposed on an inner surface of the cover plate 21, and the support columns 23 are connected to the lower cover structure 10' and forms an accommodation chamber 24 to accommodate the working fluid (not shown). Notably, in the embodiment, the lower cover structure 10' is a stepped mesh-stacked powder-filling structure 10. In other embodiments, the upper cover structure 20 can also have the same stepped mesh-stacked powder-filling structure 10 to respectively correspond to the heat source 9 that need to dissipate the heat. The present disclosure is not limited thereto and explained in advance. In the embodiment, the stepped mesh-stacked powder-filling structure 10 includes a cover plate 11, a first mesh plate 12, a second mesh plate 13 and a wick structure 14. The cover plate 11 includes an outer surface 111 and an inner surface 112 opposite to each other. Preferably but not exclusively, the outer surface 111 is attached to a heat source 9. In the embodiment, the first mesh plate 12 is stacked on the inner surface 112 of the cover plate 11 along a first direction (i.e., the Z axial direction), and a bottom surface 121 of the first mesh plate 12 is attached to the inner surface 112 of the cover plate 11. Moreover, the first mesh plate 12 includes a first through opening 120. The first through opening 120 is in fluid communication with the inner surface 112 of the cover plate 11 and spatially corresponding to the heat source 9. In the embodiment, the second mesh plate 13 is stacked on the first mesh plate 12 along the first direction (i.e., the Z axial direction), and a bottom surface 131 of the second mesh plate 13 is attached to a top surface 122 of the first mesh plate 12. Preferably but not exclusively, the second mesh plate 13 is in fluid communication with the accommodation chamber 24 through a top surface 132. Moreover, the second mesh plate 13 includes a second through opening 130. In the embodiment, the second through opening 130 is in fluid communication with the inner surface 112 of the cover plate 11 through the first through opening 120, and spatially corresponding to the first through opening 120 and the heat source 9. In the embodiment, the second through opening 130 is greater than the first through opening 120 in view of the first direction (i.e., the Z axial direction), and the top surface 122 of the first mesh plate 12 corresponding to the second through opening 130 forms a first overlapping surface S1. The first overlapping surface S1 is not covered by the second mesh plate 13. In the embodiment, the wick structure 14 is disposed in the first through opening 120 and the second through opening 130, and at least in fluid communication with the first mesh plate 12 through the first overlapping surface S1. Moreover, the wick structure 14 is thermally coupled to the heat source 9 through the inner surface 112 and the outer surface 111 of the cover plate 11.

In the embodiment, the first mesh plate 12 and the wick structure 14 are at least partially overlapped in view of the first direction (i.e., the Z axial direction). In view of the first direction (i.e., the Z axial direction), the first through opening 120 has an area not less than an area of the heat source 9 that is attached to the outer surface 11 of the cover plate 11. Preferably but not exclusively, in the embodiment, the first mesh plate 12 and the second mesh plate 13 are placed on the inner surface 112 of the cover plate 11 along the first direction, and then the first mesh plate 12 and the second mesh plate 13 are stacked and fixed on the cover plate 11 through a hot pressing process. After the hot pressing process, the first mesh plate 12 and the second mesh plate 13 are stacked on the cover plate 11, and the first through opening 120 and the second through opening 130 collaboratively form a stepped accommodation space. In the embodiment, the wick structure 14 is accommodated in the stepped accommodation space. Notably, in the embodiment, the wick structure 14 is a porous capillary structure formed by filling the stepped accommodation space with metal powder and then sintering the metal power. Preferably but not exclusively, the first mesh plate 12 and the second mesh plate 13 are a copper mesh, respectively, the metal powder is a copper powder, and the wick structure 14 has a porosity smaller than that of the first mesh plate 12 and the second mesh plate 13. Notably, when the first mesh plate 12 and the second mesh plate 13 are stacked on the cover plate 11 through the hot pressing process, the opening areas of the first through opening 120 of the first mesh plate 12 and the second through opening 130 of the second mesh plate 13 are increased vertically from the inner surface 112 of the cover plate 11, so as to form the stepped accommodation space. After the metal powder such as the copper powder is filled in the stepped accommodation space, it can be sintered into the porous wick structure 14 with the porosity smaller than the porosity of the mesh plates. Moreover, a good fluid communication between the wick structure 14 and the first mesh plate 12 is formed through the first horizontal overlapping surface S1. In this way, the first mesh plate 12 and the second mesh plate 13 in the vapor chamber 1 can smoothly guide the working fluid to flow back to the wick structure 14 in the horizontal direction (i.e., the X axial direction or the Y axial direction).

Preferably but not exclusively, in the embodiment, the first through opening 120 of the first mesh plate 12 and the second through opening 130 of the second mesh plate 13 are rectangular or square in view of the first direction (i.e., the Z axial direction), respectively. Moreover, the first overlapping surface S1 is connected between an edge of the second through opening 130 and an edge of the first through opening 120, and has an extending direction (i.e., on the XY plane) perpendicular to the first direction. In the embodiment, the first mesh plate 12 has a bottom surface 121 attached to the inner surface 112 of the cover plate 11, and the second mesh plate 13 has a bottom surface 131 attached to a top surface 122 of the first mesh plate 12. Preferably but not exclusively, the first mesh plate 12 and the second mesh plate 13 are configured to guide a working fluid to flow back to the wick structure 14 along a second direction (i.e., the X axial direction or the Y axial direction), and the second direction is perpendicular to the first direction.

Figure 7A:
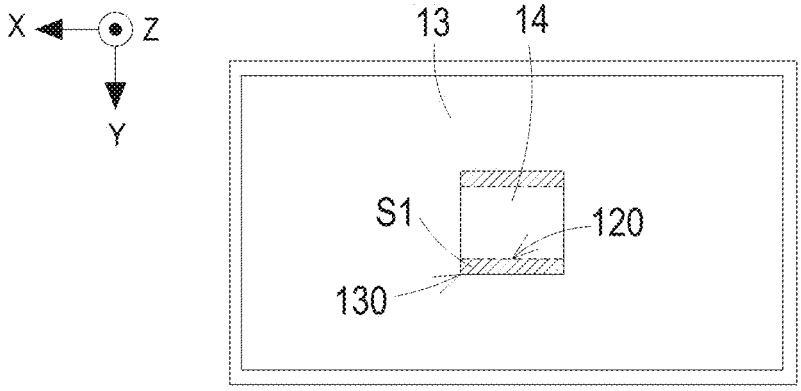
FIG. 7A to FIG. 7F show different examples of the stepped mesh-stacked powder-filling structure in the present disclosure including the first overlapping surfaces arranged on two sides.
Figure 7B:
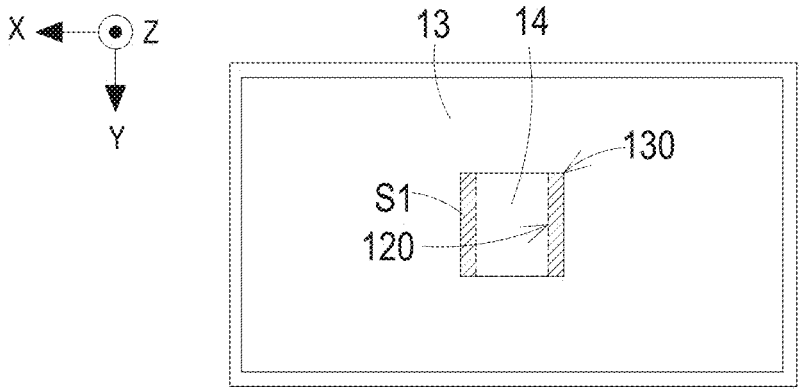
Figure 7C:
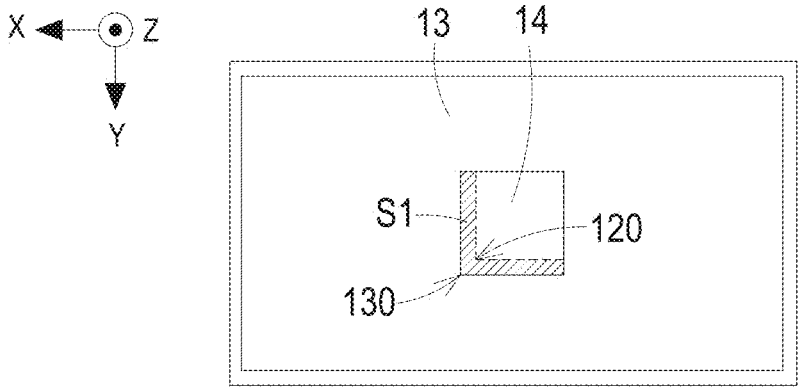
Figure 7D:
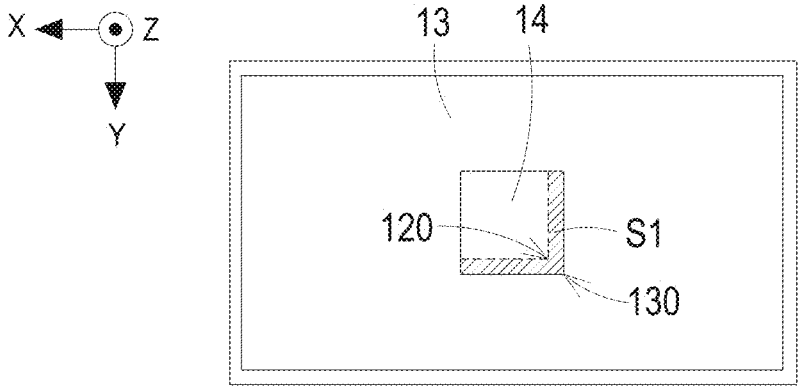
Figure 7E:
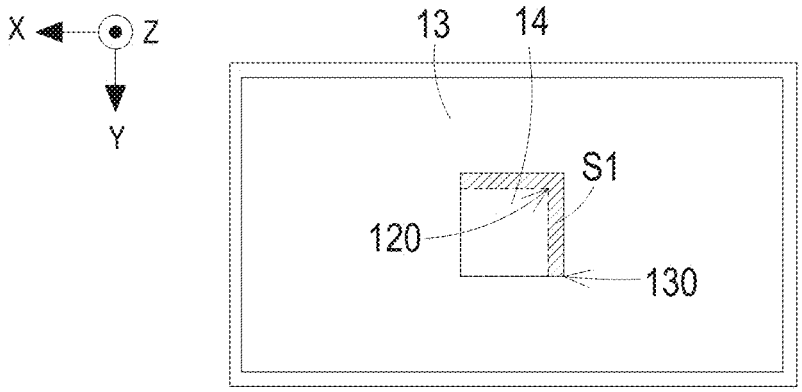
Figure 7F:
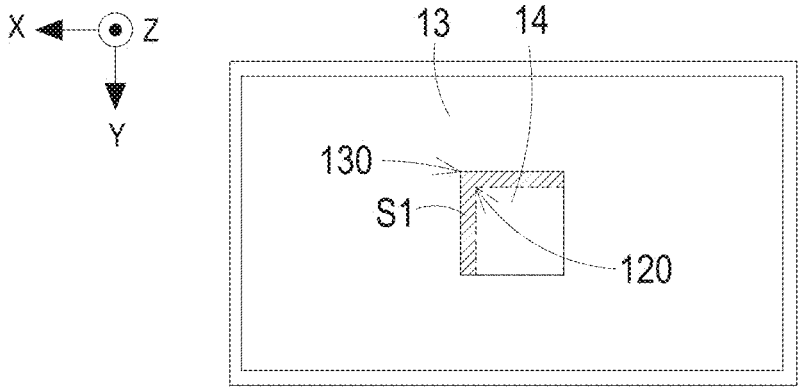
Figure 8A:
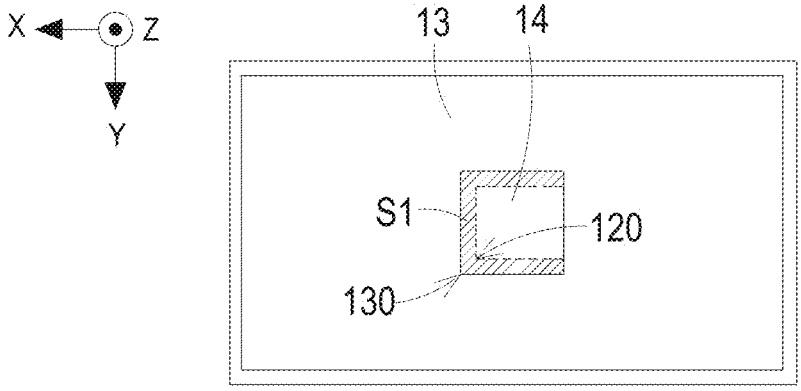
FIG. 8A to FIG. 8D show different examples of the stepped mesh-stacked powder-filling structure in the present disclosure including the first overlapping surfaces arranged on three sides.
Figure 8B:
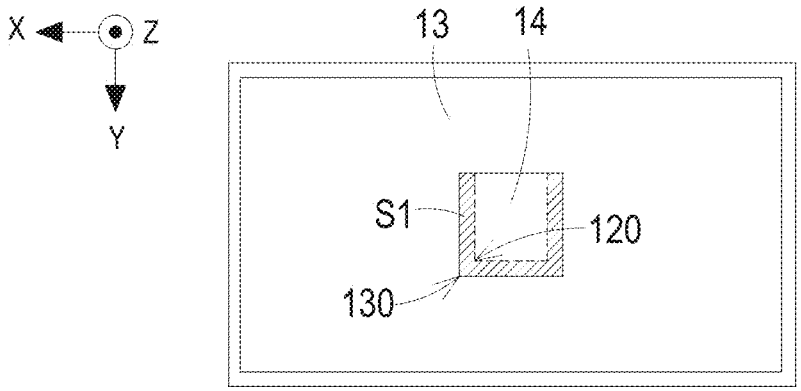
Figure 8C:
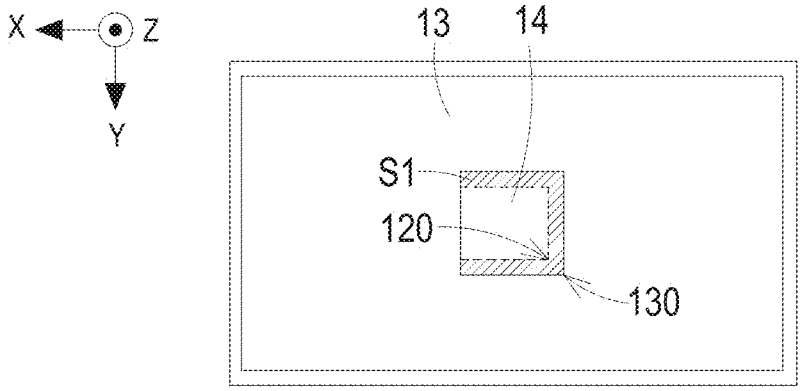
Figure 8D:
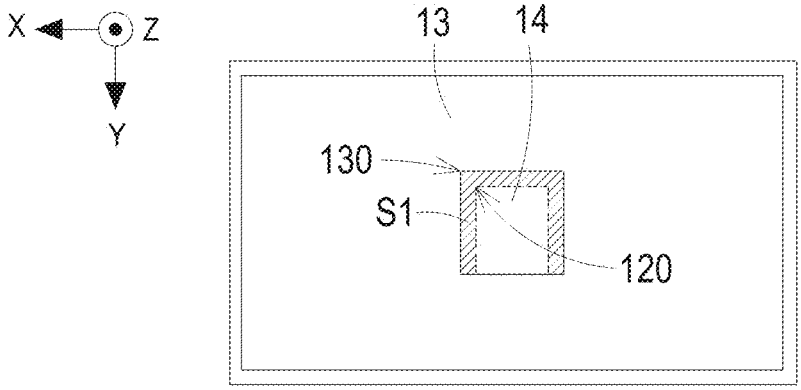
Figure 9A:
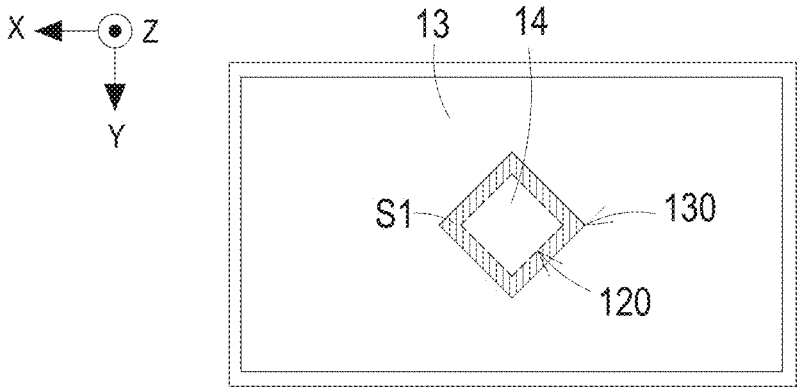
FIG. 9A and FIG. 9B show exemplary examples of the stepped mesh-stacked powder-filling structure in the present disclosure including the first overlapping surfaces with different shapes, respectively.
Figure 9B:
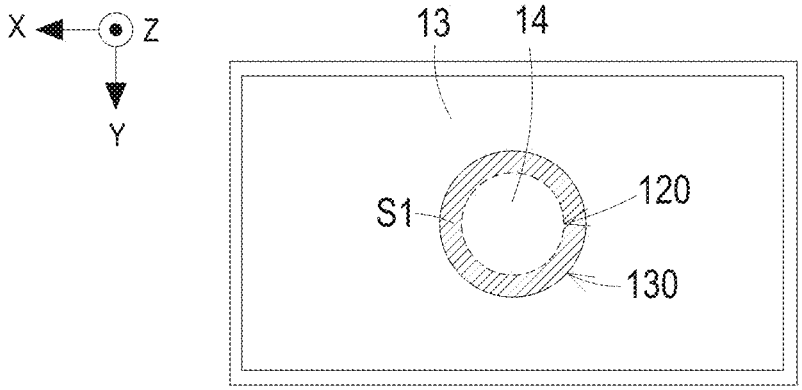

Notably, the first through opening 120 of the first mesh plate 12 and the second through opening 130 of the second mesh plate 13 are rectangular or square in view of the first direction (i.e., the Z axial direction), respectively. After the first mesh plate 12 and the second mesh plate 13 are stacked, the first overlapping surface S1 is formed to surround the four sides of the first through opening 120 (as shown in FIG. 5). In other embodiments, the position of the first through opening 120 corresponding to the second through opening 130 is adjustable according to the practical requirements, so as to facilitate the first mesh plate 12 and the second mesh plate 13 to maintain the sufficient support strength, and then complete the stacking through the hot pressing process. In an embodiment, the first overlapping surface S1 of the stepped mesh-stacked powder-filling structure 10 is merely disposed adjacent to one side of the square first through opening 120, as shown in FIG. 6A to FIG. 6D. In an embodiment, the first overlapping surface S1 of the stepped mesh-stacked powder-filling structure 10 is disposed adjacent to two opposite sides of the square first through opening 120 (as shown in FIG. 7A and FIG. 7B), or two connected sides of the square first through opening 120 (as shown in FIGS. 7C and 7D). Furthermore, in an embodiment, the first overlapping surface S1 of the stepped mesh-stacked powder-filling structure 10 is disposed adjacent to three connected sides of the square first through opening 120, as shown in FIG. 8A to FIG. 8D. In another embodiment, the first through opening 120 of the first mesh plate 12 and the second through opening 130 of the second mesh plate 13 are rhombus in view of the first direction (i.e., the Z axial direction), respectively, and the first overlapping surface S1 is disposed around an outer periphery of the first through opening 120, as shown in FIG. 9A. In a further embodiment, the first through opening 120 of the first mesh plate 12 and the second through opening 130 of the second mesh plate 13 are circular in view of the first direction (i.e., the Z axial direction), respectively, and the first overlapping surface S1 in a ring shape is disposed adjacent to an outer periphery of the first through opening 120, as shown in FIG. 9B. It can be seen from the above that in order to form the stepped accommodation space to fill the metal powder for sintering, the first mesh plate 12 and the second mesh plate 13 are stacked upwardly from the inner surface 112 of the cover plate 11 to increase the opening areas of the through openings disposed thereof and corresponding to the position of the heat source 9. The shapes of the first through opening 120 and the second through 130 can be for example but not limited to rectangular, circular or rhombus. The number of the first overlapping surfaces S1 is adjustable according to the practical requirements, and the first overlapping surface S1 can be located adjacent to a partial side or all of the periphery of the first through opening 120. In this way, the first mesh plate 12 and the second mesh plate 13 can be stacked in various ways to form the stepped accommodation space with sufficient first overlapping surfaces S1 in different regions of the cover plate 11, and then the metal powder can be filled into the stepped accommodation for sintering. Consequently, the problem of working fluid back flow disconnection caused by the different sintering shrinkage ratios of the mesh plates and the metal powder is solved sufficiently. Thereby, the heat dissipation capabilities of the vapor chamber 1 are greatly improved, the back-flow efficiency of the working fluid inside the vapor chamber 1 is greatly improved, and the overall performance of the vapor chamber 1 is improved. Certainly, the present disclosure is not limited thereto.

Figure 10:
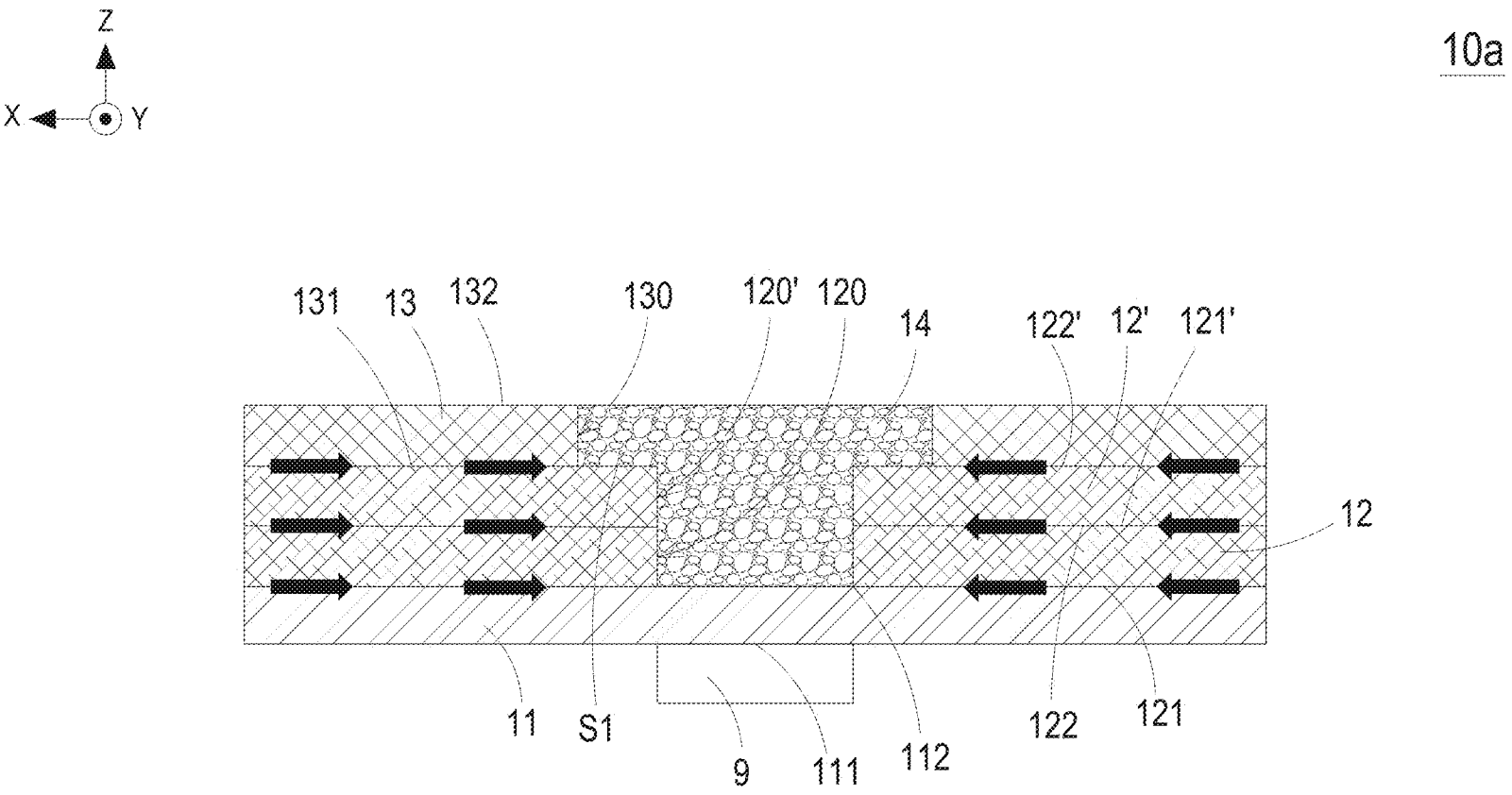
FIG. 10 is a schematic cross-sectional view illustrating a stepped mesh-stacked powder-filling structure according to a second embodiment of the present disclosure.

FIG. 10 is a schematic cross-sectional view illustrating a stepped mesh-stacked powder-filling structure according to a second embodiment of the present disclosure. In the embodiment, the structures, elements and functions of the stepped mesh-stacked powder-filling structure 10*a* are similar to those of the stepped mesh-stacked powder-filling structure 10 of FIG. 3 to FIG. 5, and are not redundantly described herein. In the embodiment, the stepped mesh-stacked powder-filling structure 10*a* further includes a heightening mesh plate 12', which is disposed between the first mesh plate 12 and the second mesh plate 13. Preferably but not exclusively, the size and the shape of the heightening mesh plate 12' are the same as those of the first mesh plate 12. In the embodiment, the heightening mesh plate 12' has a bottom surface 121' attached to the top surface 122 of the first mesh plate 12, and the second mesh plate 13 has a bottom surface 131 attached to a top surface 122' of the heightening mesh plate 12'. The second through opening 130 is in fluid communication with the inner surface 112 of the cover plate 11 through the heightening through opening 120' and the first through opening 120. In view of the first direction (i.e., the Z axial direction), the second through opening 130 is greater than the heightening through opening 120' and the first through opening 120. Moreover, the top surface 122' of the heightening mesh plate 12' corresponding to the second through opening 130 forms a first overlapping surface S1. The first overlapping surface S1 is not covered by the second mesh plate 13. In the embodiment, the wick structure 14 is disposed in the heightening through opening 120', the first through opening 120 and the second through opening 130, and at least in fluid communication with the heightening mesh plate 12' through the first overlapping surface S1. In this way, the stepped accommodation space is formed for filling the metal powder that is further sintered into the wick structure 14. Consequently, the problem of working fluid back flow disconnection caused by the different sintering shrinkage ratios of the mesh plates and the metal powder is solved sufficiently, and the heat dissipation capabilities of the product are greatly improved. In other words, the stacking heights of the first mesh plate 12 and the second mesh plate 13 for forming the stepped accommodation space are adjustable according to the practical requirements. Preferably but not exclusively, the first mesh plate 12 is formed by stacking two layers of mesh plate structure. The stepped accommodation space formed by the first mesh plate 12 and the second mesh plate 13 is helpful to solve the problem of working fluid back flow disconnection caused by the different sintering shrinkage ratios of the mesh plates and the metal powder. Certainly, the present disclosure is not limited thereto.

Figure 11:
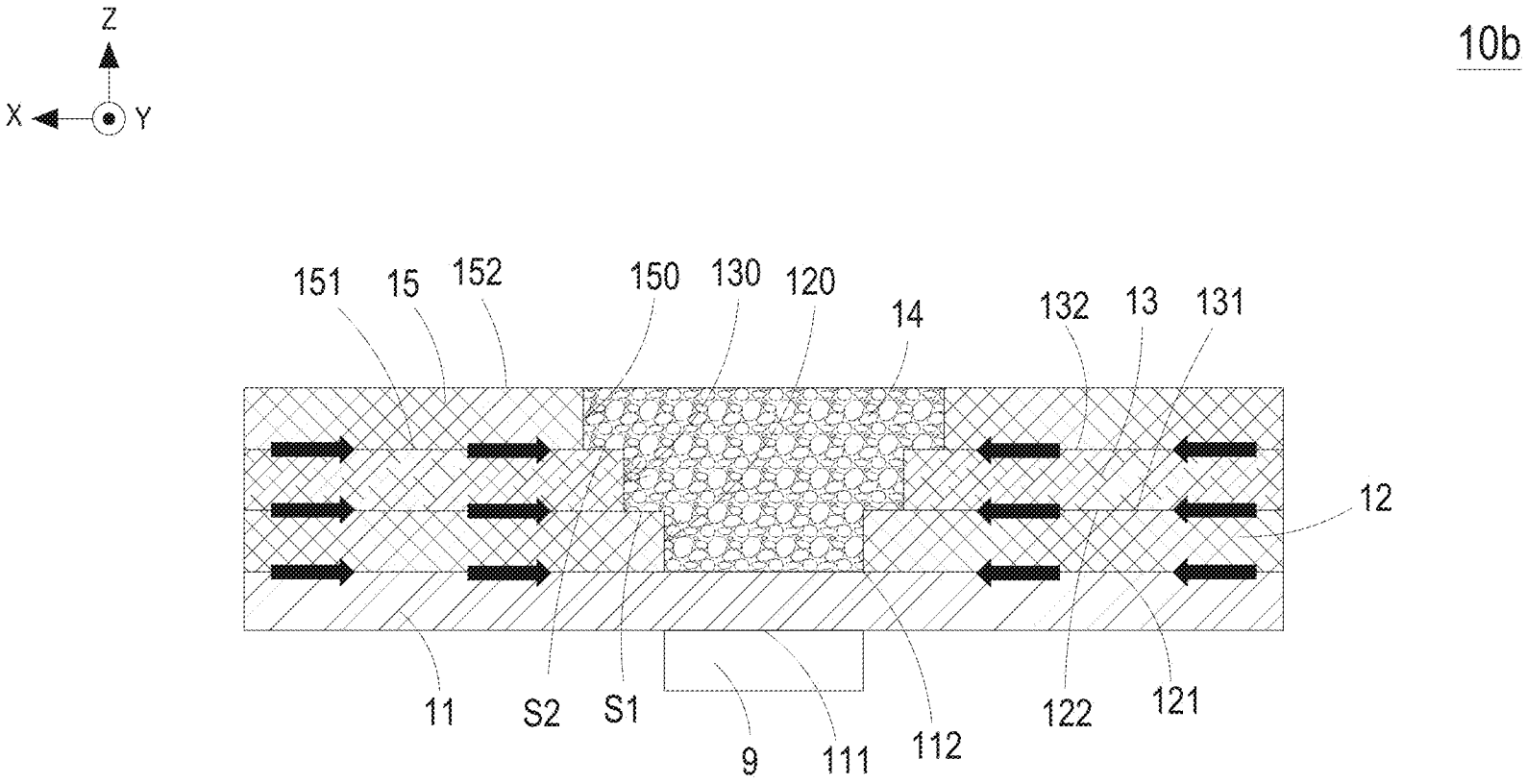
FIG. 11 is a schematic cross-sectional view illustrating a stepped mesh-stacked powder-filling structure according to a third embodiment of the present disclosure.

FIG. 11 is a schematic cross-sectional view illustrating a stepped mesh-stacked powder-filling structure according to a third embodiment of the present disclosure. In the embodiment, the structures, elements and functions of the stepped mesh-stacked powder-filling structure 10*b* are similar to those of the stepped mesh-stacked powder-filling structure 10 of FIG. 3 to FIG. 5, and are not redundantly described herein. In the embodiment, the stepped mesh-stacked powder-filling structure 10*b* further includes a third mesh plate 15. The third mesh plate 15 is stacked on top surface 132 of the second mesh plate 13 along the first direction (i.e., the Z axial direction), the bottom surface 151 of the third mesh plate 15 is attached to the top surface 132 of the second mesh plate 13, and the third mesh plate 15 is in fluid communication with the accommodation chamber 24 (referring to FIG. 3) through a top surface 152. In the embodiment, the third mesh plate 15 includes a third through opening 150. The third through opening 150 is in fluid communication with the inner surface 112 of the cover plate 11 through the second through opening 130 and the first through opening 120, and spatially corresponding to the second through opening 130, the first through opening 120 and the heat source 9. Preferably but not exclusively, the third through opening 150 is greater than the second through opening 130 in view of the first direction (i.e., the Z axial direction). In this way, the top surface 122 of the first mesh plate 12 corresponding to the second through opening 130 forms the first overlapping surface S1. The first overlapping surface S1 is not covered by the second mesh plate 13. Moreover, the top surface 132 of the second mesh plate 13 corresponding to the third through opening 150 forms a second overlapping surface S2. The second overlapping surface S2 is not covered by the third mesh plate 15. In the embodiment, the wick structure 14 is disposed in the first through opening 120, the second through opening 130 and the third through opening 150, at least in fluid communication with the first mesh plate 12 through the first overlapping surface S1, and at least in fluid communication with the second mesh plate 13 through the second overlapping surface S2. Moreover, the wick structure 14 is thermally coupled to the heat source 9 through the inner surface 112 and the outer surface 111 of the cover plate 11. In other embodiments, the numbers of the first mesh plate 12, the second mesh plate 13 and the third mesh plate 15 are adjustable according to the practical requirements, so as to form the stepped mesh-stacked powder-filling structure 10*b* with different numbers of steps. Consequently, the problem of working fluid back flow disconnection caused by the different sintering shrinkage ratios of the mesh plates and the metal powder is solved sufficiently, and the efficiency of the working fluid flowing back from the first mesh plate 12, the second mesh plate 13 and the third mesh plate 15 to the wick structure 14 is improved.

Taking a traditional vapor chamber without a stepped mesh-stacked powder-filling structure as an example, it provides the heat dissipation performance to maintain the heat source temperature at about 85° C. to 90° C. However, using the vapor chamber 1 with the stepped mesh-stacked powder-filling structure 10 in the present disclosure, it provides the heat dissipation performance to reduce the heat source temperature to 75° C. It is obvious that the vapor chamber 1 in the present disclosure can significantly reduce the temperature of the heat source and improve the performance of the vapor chamber 1 by using the stepped mesh-stacked powder-filling structure 10. Certainly, the sizes and the positions of the first through opening 120, the second through opening 130 and the third through opening 150 are adjustable according to the actual heat dissipation requirements of the heat source 9, or a double-sided heat dissipation vapor chamber can be formed. The present disclosure is not limited thereto, and not redundantly described hereafter.

In summary, the present disclosure provides a stepped mesh-stacked powder-filling structure and a vapor chamber using the same. A stepped accommodation space is formed by stacking the mesh plates for filling metal powder that is further sintered into a porous wick structure, so that the problem of working fluid back flow disconnection caused by the different sintering shrinkage ratios of the mesh plates and the metal powder is solved sufficiently. Thereby, the heat dissipation capabilities of the product are greatly improved. The vapor chamber includes an upper cover structure and a lower cover structure that are paired with each other. The stepped mesh-stacked powder-filling structure is disposed and corresponding to the heat source, and can be formed on the upper cover structure or/and the lower cover structure. When a plurality of mesh plates are stacked on the cover plate through a hot pressing process, the opening areas of the through openings in the plural mesh plates are increased vertically from the inner surface of the cover plate to form a stepped accommodation space. After the metal powder such as the copper powder is filled in the stepped accommodation space, it can be sintered into a porous wick structure with a porosity smaller than the porosity of the mesh plates. Moreover, a good fluid communication between the wick structure and the mesh plates is formed through the first horizontal overlapping surface. In this way, the mesh plates in the vapor chamber can smoothly guide the working fluid to flow back to the wick structure in the horizontal direction. In order to form a stepped accommodation space to fill the metal powder for sintering, a plurality of mesh plates are stacked upwardly from the inner surface of the cover plate to increase the opening areas of the through openings disposed thereof and corresponding to the position of the heat source. Preferably, the shape of the through openings is for example but not limited to rectangular, circular or rhombus. The number of the first overlapping surfaces is adjustable according to the practical requirements. Moreover, the first overlapping surface can be located adjacent to a partial side or all of the periphery of the corresponding through opening. In this way, the plurality of mesh plates can be stacked in various ways to form the stepped accommodation space with sufficient first overlapping surfaces in different regions of the cover plate, and then the metal powder can be filled into the stepped accommodation for sintering. Consequently, the problem of working fluid back flow disconnection caused by the different sintering shrinkage ratios of the mesh plates and the metal powder is solved sufficiently. Thereby, the heat dissipation capabilities of the product are greatly improved, the backflow efficiency of the working fluid inside the vapor chamber is greatly improved, and the overall performance of the vapor chamber is improved.

While the disclosure has been described in terms of what is presently considered to be the most practical and preferred embodiments, it is intended to cover various modifications and similar arrangements included within the spirit and scope of the appended claims which are to be accorded with the broadest interpretation so as to encompass all such modifications and similar structures.

What is claimed is:

1. A stepped mesh-stacked powder-filling structure, comprising:

a cover plate comprising an outer surface and an inner surface opposite to each other;

a first mesh plate stacked on the inner surface of the cover plate along a first direction, and comprising a first through opening, wherein the first through opening is in fluid communication with the inner surface;

a second mesh plate stacked on the first mesh plate along the first direction and comprising a second through opening, wherein the second through opening is in fluid communication with the inner surface through the first through opening, the second through opening is greater than the first through opening in view of the first direction, and a top surface of the first mesh plate corresponding to the second through opening forms a first overlapping surface that is not covered by the second mesh plate; and a wick structure disposed in the first through opening and the second through opening, and at least in fluid communication with the first mesh plate through the first overlapping surface.

2. The stepped mesh-stacked powder-filling structure according to claim 1, wherein the first mesh plate and the wick structure are at least partially overlapped in view of the first direction.

3. The stepped mesh-stacked powder-filling structure according to claim 1, wherein the outer surface of the cover plate is attached to a heat source, and the first through opening has an area not less than that of the heat source in view of the first direction.

4. The stepped mesh-stacked powder-filling structure according to claim 1, wherein the first mesh plate and the second mesh plate are stacked on the cover plate through a hot pressing process.

5. The stepped mesh-stacked powder-filling structure according to claim 1, wherein the first mesh plate has a bottom surface attached to the inner surface of the cover plate, and the second mesh plate has a bottom surface attached to a top surface of the first mesh plate, wherein the first mesh plate and the second mesh plate are configured to guide a working fluid to flow back to the wick structure along a second direction, and the second direction is perpendicular to the first direction.

6. The stepped mesh-stacked powder-filling structure according to claim 1, wherein the first overlapping surface is connected between a peripheral edge of the second through opening and a peripheral edge of the first through opening, and the first overlapping surface has an extending direction perpendicular to the first direction.

7. The stepped mesh-stacked powder-filling structure according to claim 1, wherein the first through opening and the second through opening are rectangular in view of the first direction, respectively, and the first overlapping surface is disposed adjacent to one side, two connected sides, and two opposite sides, or three connected sides of the first through opening.

8. The stepped mesh-stacked powder-filling structure according to claim 1, wherein the first through opening and the second through opening are circular in view of the first direction, respectively, and the first overlapping surface is disposed adjacent to an outer periphery of the first through opening.

9. The stepped mesh-stacked powder-filling structure according to claim 1, wherein the first through opening and the second through opening are rhombus in view of the first direction, respectively, and the first overlapping surface is disposed around an outer periphery of the first through opening.

10. The stepped mesh-stacked powder-filling structure according to claim 1, wherein the first through opening and the second through opening collaboratively form a stepped accommodation space, and the wick structure is accommodated in the stepped accommodation space.

11. The stepped mesh-stacked powder-filling structure according to claim 10, wherein the wick structure is a porous capillary structure formed by filling the stepped accommodation space with metal powder and then sintering the metal power.

12. The stepped mesh-stacked powder-filling structure according to claim 11, wherein the first mesh plate and the second mesh plate are a copper mesh, respectively, the metal powder is a copper powder, and the wick structure has a porosity smaller than that of the first mesh plate and the second mesh plate.

13. The stepped mesh-stacked powder-filling structure according to claim 1, wherein the first mesh plate is formed by stacking two layers of mesh plate structure.

14. The stepped mesh-stacked powder-filling structure according to claim 1, further comprising a third mesh plate, wherein the third mesh plate is stacked on the second mesh plate along the first direction, and comprises a third through opening, wherein the third through opening is in fluid communication with the inner surface through the second through opening and the first through opening, and spatially corresponding to the second through opening and the first through opening, wherein the third through opening is greater than the second through opening in view of the first direction, and a top surface of the second mesh plate corresponding to the third through opening forms a second overlapping surface that is not covered by the third mesh plate, wherein the wick structure is disposed in the first through opening, the second through opening and the third through opening, at least in fluid communication with the first mesh plate through the first overlapping surface, and at least in fluid communication with the second mesh plate through the second overlapping surface.

15. A vapor camber, comprising:

an upper cover structure and a lower cover structure paired and assembled with each other to form the vaper chamber, wherein the upper cover structure or/and the lower cover structure comprises a stepped mesh-stacked powder-filling structure, and the stepped mesh-stacked powder-filling structure comprises:

a cover plate comprising an outer surface and an inner surface opposite to each other;

a first mesh plate stacked on the inner surface of the cover plate along a first direction, and comprising a first through opening, wherein the first through opening is in fluid communication with the inner surface;

a second mesh plate stacked on the first mesh plate along the first direction and comprising a second through opening, wherein the second through opening is in fluid communication with the inner surface through the first through opening, the second through opening is greater than the first through opening in view of the first direction, and a top surface of the first mesh plate corresponding to the second through opening forms a first overlapping surface that is not covered by the second mesh plate; and a wick structure disposed in the first through opening and the second through opening, and at least in fluid communication with the first mesh plate through the first overlapping surface.

* * * * *